United States Patent [19]

Arndt

[11] Patent Number: 4,992,788

[45] Date of Patent: Feb. 12, 1991

[54] TRAFFIC CONTROL TRAILER SYSTEM

[75] Inventor: Rudolf P. Arndt, Lakeland, Fla.

[73] Assignee: International Traffic Systems, Inc., Lakeland, Fla.

[21] Appl. No.: 416,119

[22] Filed: Oct. 2, 1989

[51] Int. Cl.[5] ..... G08G 1/095

[52] U.S. Cl. ..... 340/908; 340/473; 116/63 R

[58] Field of Search ..... 340/908, 908.1, 473, 340/431, 907, 472; 248/124, 207, 359 R, 359 H; 116/63 R, 63 P

[56] References Cited

U.S. PATENT DOCUMENTS

| | | | |
|---|---|---|---|
| 2,941,185 | 6/1960 | Mullikin . | |
| 3,995,250 | 11/1976 | Ferree | 340/908 |
| 4,543,905 | 10/1985 | McKenney | 340/908 |
| 4,616,225 | 10/1986 | Woudenberg | 340/908 |
| 4,706,087 | 11/1987 | Holznagel | 340/908 |

OTHER PUBLICATIONS

Sales brochure entitled "Trafficmaster Portable Traffic Control Signal," by Material Sales, Inc., 3116 S. Roosevelt, Tempe, Arizona 5-21-90.

Sales brochure entitled "Temp-Lite," provided by Handling Equipment, Ltd. 5-21-90.

*Primary Examiner*—Donnie L. Crosland

*Attorney, Agent, or Firm*—Pettis & McDonald

[57] ABSTRACT

A portable traffic control system for control of traffic at temporary locations includes a trailer having a base supported by an axle and wheels, two signal supports connected to the base and an actuating mechanism for selectively urging the signal supports from a transporting position to an operating position and back. A transverse arm connected to one signal support is extendable laterally and outwardly from the trailer. A signal head is attached to the transverse arm and a second signal head is attached to the upper end of the second signal support.

13 Claims, 3 Drawing Sheets

TRAFFIC CONTROL TRAILER SYSTEM

BACKGROUND OF THE INVENTION

This invention relates to the field of portable traffic control systems for use at temporary locations on streets and highways. More specifically, the invention relates to the trailer structure for transporting and erecting such traffic control signals.

In the construction and transportation industries there has long been a requirement for portable traffic control systems that can be located on or adjacent to highways and city streets. These signals are required where road construction is underway and requires that traffic be temporarily rerouted or traffic flow be controlled. Such apparatus is also necessary when permanent signal installations have been damaged or otherwise rendered inoperable, thus requiring some temporary traffic control while repairs are being effected. An alternative to portable systems is the use of flag personnel or traffic officers, who would have to be present 24 hours a day, thus requiring a substantial investment in manpower.

Several portable traffic signals have been found in the prior art, and some of them have filled some of the basic needs for such units, although all have been found wanting in one or more areas. Most of these prior art units fail to meet highway department standards in various states and are not effective for their intended purpose. Certain of these prior art units provide a signal only at the side of the road and do not include the inportant signal positioned over the roadway for increased visibility. One unit, disclosed in Woudenberg, U.S. Pat. No. 4,616,225, overcomes a number of these disadvantages and provides a signal head both at the side of the road and positioned over the road. However, the Woudenberg structure, by its basic configuration, requires that it be assembled and disassembled from the support each time the unit is to be transported and erected. To prepare this unit for operation, each of the two signal heads must be removed from their carriers on the trailer and attached to the operating supports. These supports are then raised and extended into position. Such assembly and disassembly is time consuming and presents additional opportunities for dropping or otherwise damaging the signal head.

SUMMARY OF THE INVENTION

In order to overcome the disadvantages of the prior art portable traffic signaling devices, it is an object of the present invention to provide such a traffic control trailer system in which a plurality of traffic control signal heads are mounted to that apparatus to provide good visiblity for the signal. It is another object to provide such an apparatus including at least two signal supports extending upwardly from the base of the trailer to provide a more rigid support for the traffic signal heads. To provide these and other adventages, which will become clear to those skilled in the art, there is provided a traffic control trailer system including a trailer having a base with a front portion and a rear portion and an axle with wheels mounted thereon. The trailer includes a first signal support and a second signal support, each extending upwardly and connected to the base, with each signal support having an upper end, and an actuating means connected to the base and to the signal supports selectively urging the upper ends of the signal supports away from the base, such that the signal supports may be elevated and lowered between an operating position and a transporting position by selective operation of the actuating means. The trailer also includes a transverse arm having opposing ends, with one of the ends being connected to the upper end of the first signal support, so that when the first signal support is in the operating position the transverse arm extends from the first signal support laterally outwardly of the trailer with a first traffic control signal head attached to the transverse arm and a second traffic control signal head attached to the upper end of the second signal support.

BRIEF DESCRIPTION OF THE DRAWINGS

A particularly preferred embodiment of the apparatus of this invention will be disclosed in detail in which.

DESCRIPTION OF A PREFERRED EMBODIMENT

Figure 4:
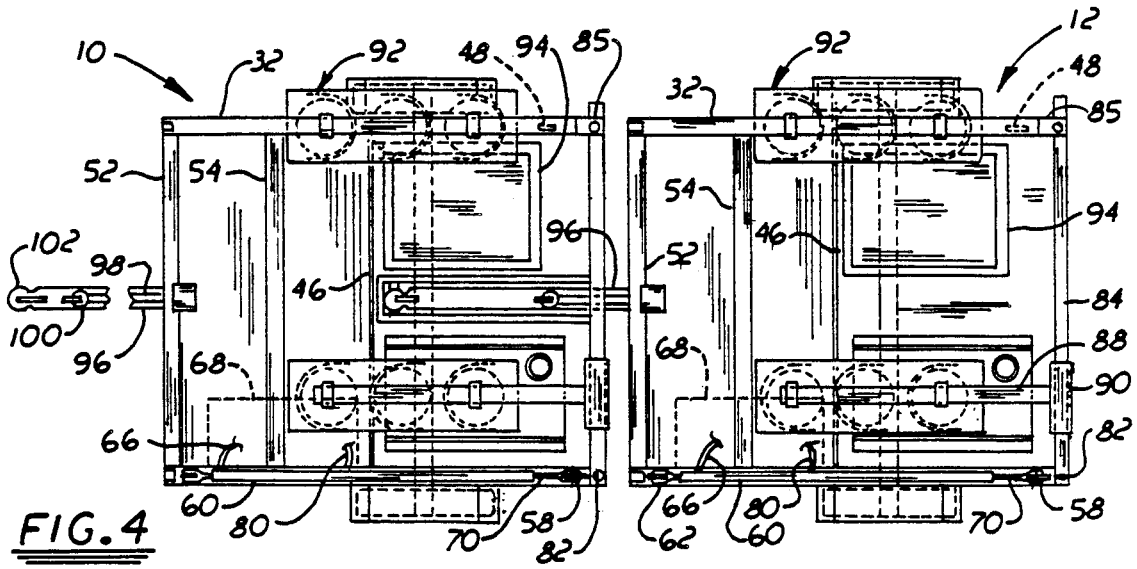
FIG. 4 is a top plan view of the two trailers of this invention in a nested transport position.

A particularly preferred embodiment of the present invention is illustrated in FIGS. 1–4. Two nested trailers are shown in FIG. 4, comprising a preferred combination of this invention. However, the basic invention resides in the structure of the trailer and signal supports, and a single such trailer unit may be used independently if so desired. In general, the two trailers of FIG. 4 differ only in the provision for connecting mechanism in the front trailer, which is omitted in the rear trailer. Accordingly, for simplicity, the invention will be described in detail in connection with the front trailer 10, it being understood that the rear trailer 12 includes the same components except for the connecting mechanism. Of course, it is obvious that both trailers could, if desired, include the same connecting mechanism mounted to the trailer base.

Figure 1:
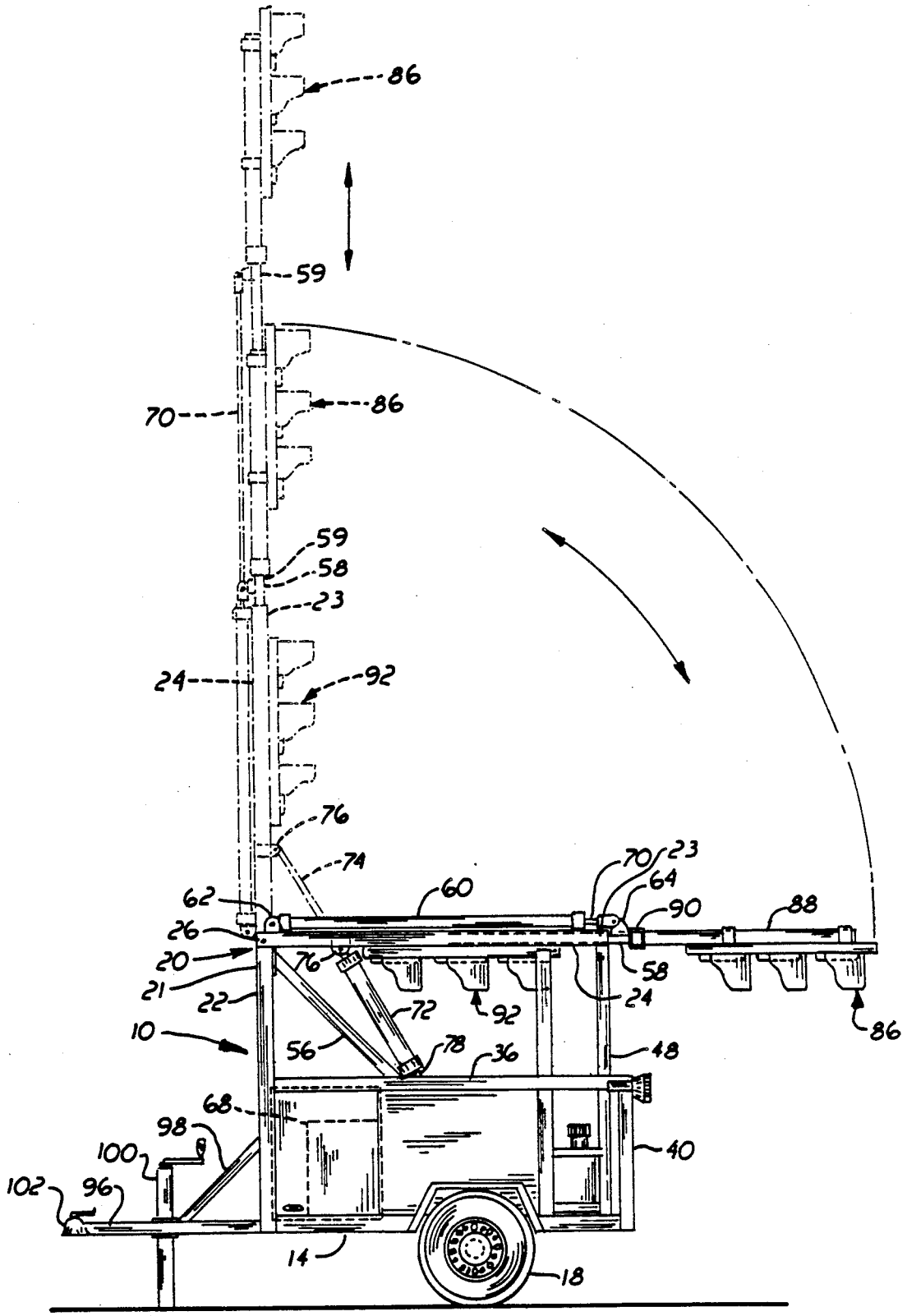
FIG. 1 is a side elevational view of one of the traffic control trailers of the present invention.

With reference to FIG. 1 the trailer comprises, in general, a base 14 mounted by conventional suspension to an axle 16, which carries wheels 18 at its outer extermities. The general fabrication of the trailer may suitably be conventional, as by welding and bolting steel angle and steel tubing in the well known manner.

A first signal support 20 includes a lower section 22, suitably affixed to and extending generally vertically upwardly from the base 14, and an upper section 24, attached by pivotal connection 26 at one end to the upper end 21 of lower section 22. A second signal support 28 similarly includes a lower section 30 and an upper section 32, connected by a pivotal connection 34, in a manner generally similar to that of connection 26. The upper end 23 of upper section 24 of first signal support 20 also, obviously comprises the upper end of the first signal support 20. Likewise, upper end 31 of upper section 32 of second signal support 28 comprises the upper end of the second signal support 28.

Connected to the respective lower sections 22 and 30 of the first and second signal supports is a frame on the trailer, suitably also fabricated of welded steel tubing. This frame includes horizonatal side members 36 and 38, the rear ends of which are support by frame uprights 40 and 42, respectively. Additional horizontal cross bracing may also extend between various positions on the side members 36 and 38 to provide additional lateral support. Typical of these cross members are supports 44 and 46 shown on FIGS. 2 and 3. As shown in FIGS. 1 and 3, vertical supports 48 and 50 may be provided proximal the rear of the trailer to engage the signal support portions 24 and 32 when they are in their generally horizontal, transporting position, such as illustrated in FIG. 1.

As shown most clearly in FIG. 3, transverse cross member 52 may extend between and support the signal supports 22 and 30, with an additional cross member 54 extending between and bracing signal support upper sections 24 and 32. A diagonal support 56 may provide additional bracing between signal support member 22 and frame member 36.

Upper section 24 of the first signal support 20 includes a telescoping extension member 58 that is slidably received within the upper end 23 of the upper section 24, for telescopically extending the effective length of that upper section 24, as shown by the phantom line representation in FIG. 3. To provide for this extension a suitable actuating means, which preferably may be a hydraulic or pneumatic cylinder 60, is connected between an attachment 62 affixed to the upper section 24 of the first signal support 20 and a second attachment 64 affixed to the upper end 59 of the extension member 58, as shown most clearly on FIG. 1. The piston of this cylinder 60 is connected through appropriate conduit structure 66 to a conventional and well known, selectively operable source of compressed fluid, such as a hydraulic pump 68, indicated in phantom in FIG. 1, with conventional controls for controlling the introduction and release of pressurized fluid into the actuating cylinder 60. Thus, by selective introduction of the pressurized fluid from the selectively controllable source 68 through the conduit 66 into the cylinder 60, the piston and its rod 70 carried by that cylinder 60 may be selectively extended to effect telescopic extension and retraction of the first signal support, as illustrated in FIGS. 1 and 3.

Also connected to upper section 24 of the first signal support 20 is another actuating means 72, which conveniently may also be a fluid actuated cylinder, generally similar to that of cylinder 60. One portion of this actuator 72, suitably the extensible piston and its associated piston rod 74, is attached, suitably by pivotal connection 76, to the upper section 24 of the first signal support 20, as shown most clearly in FIG. 1. The opposite end of the cylinder is connected, suitably through pivotal attachment 78, to the frame member 36 and thence to the base 14 of the trailer 10. A suitable conduit structure 80 connects the cylinder 72 to a conventional source of selectively controllable pressurized fluid, such as the hydraulic pump and valve assembly generally illustrated by the reference numeral 68 in FIGS. 1 and 2. By selective introduction of pressurized fluid through the conduit structure 80 into the cylinder 72, the piston 74 may be extended, thus pivoting the upper end 23 of the upper section 24 of the first signal support and its attached upper end 31 of the upper section 32 of the second signal support away from the base 14 to the upright position illustrated in FIG. 3 and in phantom in FIG. 1. By appropriate withdrawal of the pressurized fluid from cylinder 72, the assembly may be retracted downwardly to the generally horizontal, transporting position illustrated in the solid line representation of FIG. 1.

Attached to the first signal support 20, preferably by pivotal connection 82 to the extensible portion 58, is transverse arm 84. One of the ends of this transverse arm 84 incorporates the pivotal connection 82 of this transverse arm 84 to the upper end of the upper section 24 of the first signal support, suitably to the upper end 59 of the extension 58, with the opposite end of the transverse arm extending outwardly therefrom. This pivotal connection, or articulating joint 82, which suitably may be conventional in construction, permits the transverse arm 84 to be pivoted, suitably about 180 degrees, from the folded transporting position illustrated in the solid line representation of FIGS. 2 and 4 to the operating position illustrated in FIGS. 1 and 3 and in phantom in FIG. 2. As shown most clearly in FIG. 3, when that transverse arm 84 is in its operating position, the arm 84 extends from the first signal support 24 laterally outwardly of the trailer. When the transverse arm 84 is in the transport position it is releasably supported by the upper end of the upper section 32 of the second signal support 28. Preferably, the transverse arm 84 may be received within this yoke or saddle shaped member 85, shown in FIGS. 2, 3 and 4. The releasable holding machanism may be any suitable latching machanism, conventional pin system or other similar suitable structure. By holding the transverse arm 84 in the transport position not only is the arm 84 stored out of the way, but the rigidity and stability of the trailer are improved for transport. While a pivotal connection or articulating joint 82 is the preferred embodiment, it can be easily seen that a conventional ball and socket joint or other similar conventional joint, that permits the transverse arm to be attached to the extensible portion 58 either inwardly to the trailer (the storage position) or outwardly to the trailer (the operating position) may be used.

Carried on the transverse arm 84 is a first traffic control signal head 86, which may be of any suitable design, incorporating flashing lights or the traditional red-yellow-green combination. This signal head may suitably be of conventional configuration such as is readily available from Lexalite or other sources. This traffic control signal head 86 is connected through conventional wiring to any suitable source of power, such as batteries or a generator, and to appropriate timing and control mechanisms, which form no part of the present invention and are illustrated generally as box 94. This traffic control signal head 86 is mounted to a support 88 that is carried by suitable means 90 engaging the transverse arm 84. The supporting means 90 may conveniently have the form of a sleeve slidably carried by the arm 84 and may be provided with conventional means, such as pins or detents, for setting and holding the sleeve 90 in selected positions along the arm 84, as is shown in phantom in FIG. 2.

Figure 2:
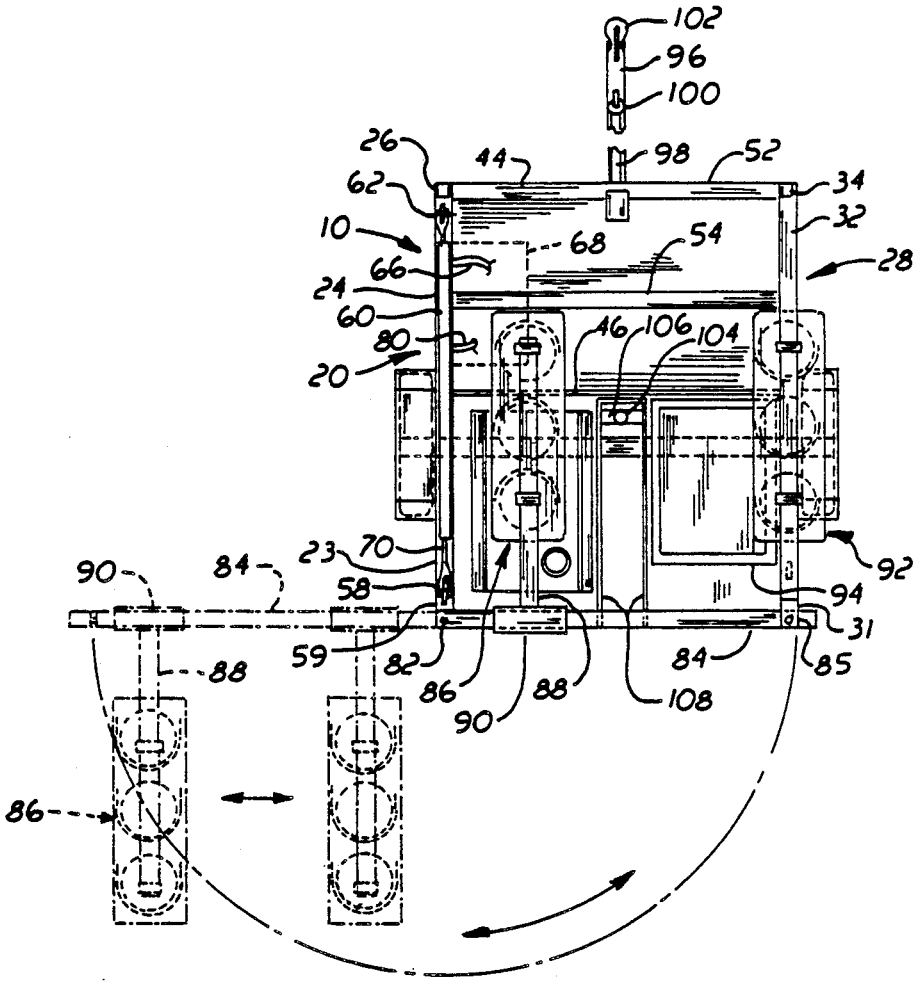
FIG. 2 is a top plan view of the traffic control trailer of FIG. 1.
Figure 3:
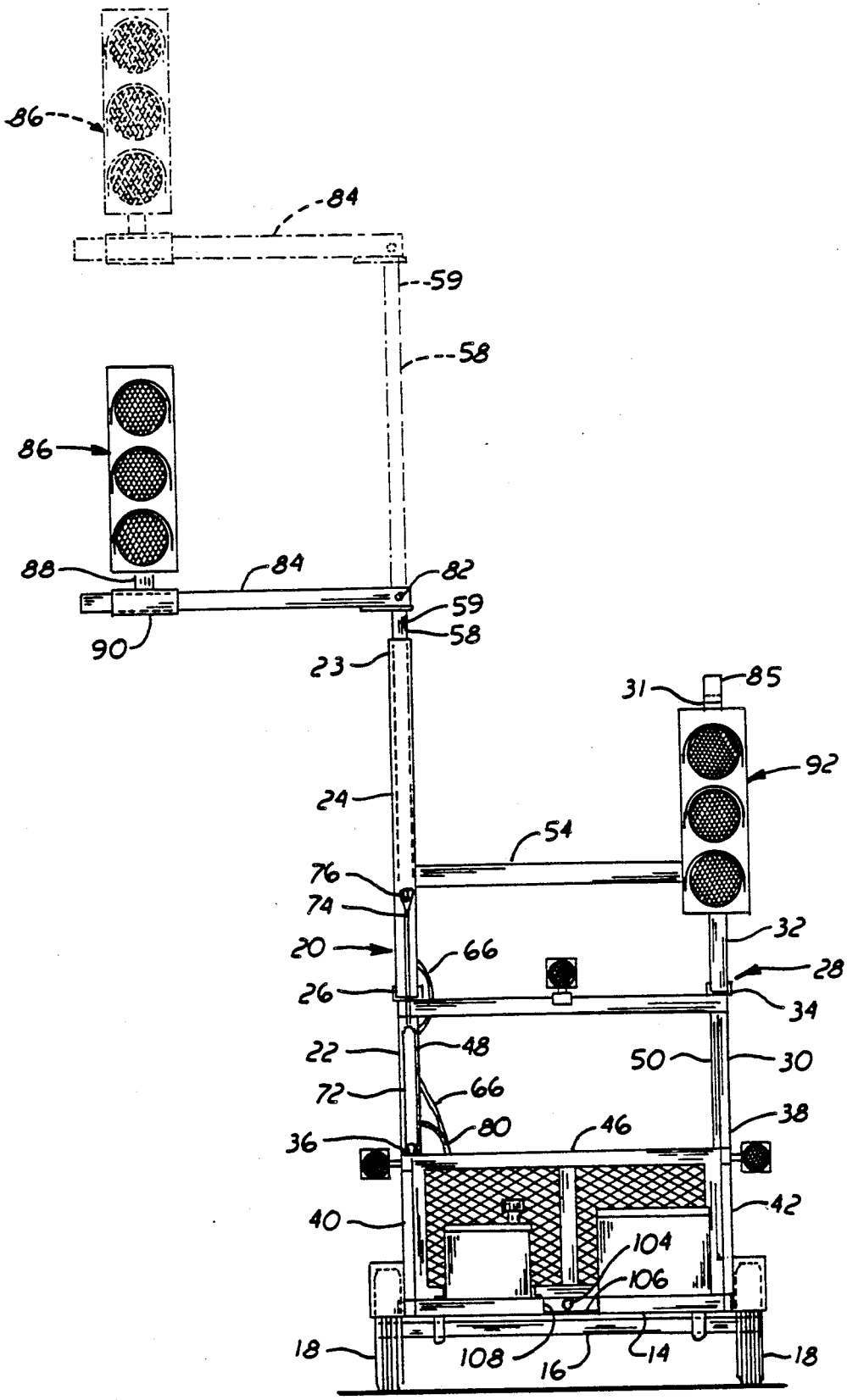
FIG. 3 is a rear elevational view of the traffic control trailer of this invention.

In this embodiment a second traffic control signal head 92 is connected to the upper section 32 of the second signal support 28, as shown most clearly in FIGS. 2 and 3. This second traffic control signal head 92 may be mounted to the support member 32 either fixedly or by means providing for sliding longitudinally of that member 32. Obviously, this second traffic control signal head 92 may be substantially the same as first traffic control signal head 86 and preferably is connected to the same source of electrical current and control signals, which may be conventional and well known in the art and suitably may be represented by the box carrying reference numeral 94 on the trailer.

At the front of the trailer there is provided a hitching machanism including trailer tongue 96, conveniently with a brace 98 extending from the trailer frame to the tongue, a conventional trailer jack 100 to support the trailer when not attached to another vehicle, and a conventional trailer hitch 102, which may conveniently be of the ball and socket type of hitch.

In the base of the trailer there preferably is provided a hiching means for joining a pair of trailers in the manner illustrated in FIG. 4. Preferably this trailer base hitching means includes a hitch portion 104, such as a hitch ball, conveniently mounted to a member 106 affixed to the base 14 of the trailer. Preferably this hitching means 104, such as the hitch ball, is mounted close to the longitudinal position of the axle 16, to reduce the effects of any pitching motion of the front trailer to the rear trailer. In the preferred embodiment the hitching means 104 is positioned slightly ahead of axle 16. The base 14 of the trailer is also provided with articulation limiting means for limiting the pivotal movement of the tongue of the second or rear trailer (FIG. 4) about a generally vertical axis extending through the hitching means 104 of the front or first trailer. This articulation limiting means 108 may suitably comprise in this preferred embodiment a slot extending longitudinally from the hitching means 104 to the rear of the trailer so that the tongue 96 of the rear trailer 12 (FIG. 4) is received within that recessed area 108. Thus, the lateral pivoting meovement of the tongue 96 of the second trailer 12 about a vertical axis extending through the hitching means 94 is limited to a predetermined maximum angle limited by the amount that the tongue can swing within that recess 108. For this embodiment this angle is preferably about 10°. Obviously, alternative configurations of the articulation limiting means could provide for the trailer tongue of second trailer 12 being positioned above the base of the first trailer 10 with built up portions or stops affixed to the base 14 of the first trailer 10 to limit its pivoting movement. By providing for a limited amount of pivoting movement of the second trailer 12 relative to the first trailer 10, the combined trailers (FIG. 4) will track and turn corners with less skidding and scrubbing the tires than would occur in the prior art in which the two trailers are rigidly joined together. Also, by limiting the amount of articulation, the combined pair of trailers shown in FIG. 4 can be backed by a towing vehicle with less danger of jackknifing than would be the case were the articulation unlimited. This arrangement also permits the use of full length trailer tongues 96 on both the first and second trailers, so that they may be pulled independently of one another, while still providing for a compact arrangement when both are to be pulled together.

As noted above, the illustrations of FIGS. 1-3 are directed to first trailer 10, which includes the articulation limiting means 108. Second trailer 12 may suitably be substantially identical to first trailer 10, with the exception of the articulation limiting means 108 and the additional hitching means 104. Alternatively, it may be convenient to provide that both trailers 10 and 12 include such additional hitching means 104 and articulation limiting means 108 to provide for fully standardized units and also to enable either trailer to be interchangeable in towing position, if desired.

With the structure of this traffic control trailer system having been described above, the manner of use and operation will now be set forth. Typically, two trailers will be towed to the operation site in the configuration shown in the top plan view of FIG. 4. This will enable control of traffic from two different directions. Obviously, if it were desired only to control traffic from a single direction, a single such trailer could be used effectively. At the operation site, one of the trailers will be parked on one side of the roadway, with its rear facing toward oncoming traffic, and the other trailer will typically be placed on the opposite side of the roadway, with the rear of that other trailer facing the oncoming traffic from the opposite direction. The trailer jacks 100 or outriggers (not shown), or both, on each of these respective trailers will be extended to support the trailers when they are detached from the towing vehicle.

When the trailers have been parked, the transverse arm 84 will be released from the holding member 85 and then the transverse arm 84 will be swung some 180 degrees from the solid line position of FIG. 2 to the broken line position illustrated. Then the first signal head 86 may be moved along the transverse arm 84 from its position proximal the pivoting or articulating joint 82 to a position proximal the outer end of the transverse arm 84, as shown in the broken line representation of FIG. 2. At that point pressurized fluid from the controllable source 68 will be introduced through the conduit 80 to the actuating cylinder 72 to drive the piston and its rod 74 outwardly of that cylinder 72, thus pivoting the connected upper sections 24 and 32 of the respective first and second signal support 20 and 28 about the respective pivotal connections 26 and 34 from the horizontal transporting position illustrated in the solid line representation of FIG. 1 to the erected, operating position illustrated in the broken line representation of FIG. 1. Next, pressurized fluid from that same source 68 may be applied through conduit 66 to actuating cylinder 60 to drive the piston and its connecting rod 70 outwardly of that cylinder, thus effecting the telescopic extension of the member 58 that is slidably received within the upper section 24 of the first signal support. This will effect raising of the first traffic control signal head 86 from the position illustrated in the solid line representation of FIG. 3 to that illustrated in the broken line representation. This will then place the first traffic control signal head 86 at the desired height above and extending out over the roadway traffic lane. The erection of the signal supports to their generally vertical, operating position also swings the second traffic control signal head 92 into the position illustrated in FIGS. 1 and 3. This second traffic control signal head 92 then provides the desirable additional signaling capability off to the side of the traffic flow. The traffic signals may then be controlled in the conventional manner for controlling the flow of traffic, although this, with the signaling mechanism constitute no part of the present invention.

When the need for such a portable traffic control signal has ended, the system may be reconfigured for subsequent transportation to another site by simply reversing the steps noted above. This will effect lowering of the first traffic control signal head 86 and transverse arm 84, swinging upper sections of the signal supports from their upright, operating position down to the generally horizontal transporting position and repositioning the first signal head and folding the transverse arm 84 into the holding member 85 and thus back to its configuration illustrated in FIGS. 2 and 4. In this retracted, transporting configuration the support members 48 provide support for the rear portions of the signal supports. At this point, where two trailers have been used, the second trailer may again be brought into nested configuration with its hitch 102 engaging the hitching means or ball 104 of the first trailer for subsequent transport to another site.

While the foregoing describes a particularly preferred embodiment of this invention, it is to be understood that numerous other variations and modifications of this structure, all within the scope of the invention, will readily occur to those skilled in the art. Obviously, in place of the two combined trailers described, a single such trailer could be used where control is desired only from one direction. Also, numerous structural modifications will readily occur. Accordingly, the foregoing description is intended to be illustrative only of the principles of this invention and is not to be considered limitative thereof. The scope of this invention is to be defined solely by the claims appended hereto.

What is claimed is:

1. A traffic control trailer system comprising a trailer having a base with a front portion and a rear portion and an axle with wheels mounted thereon said trailer further comprising;

a first signal support and a second signal support connected to said base, with each said signal support extending upwardly and having an upper end;

actuating means connected to said base and to said signal supports for selectively urging said upper ends of said signal supports pivotally away from said base, such that said signal supports may be elevated and lowered between an operating position and a transporting position by selective operation of said actuating means;

a transverse arm having opposing ends, one of said ends being connected to said upper end of said first signal support, such that, when said first signal support is in said operating position, said transverse arm extends substantially horizontally from said first signal support laterally outwardly of said trailer; and a first traffic control signal head attached to said transverse arm and a second traffic control signal head connected to said upper end of said second signal support.

2. A traffic control trailer system as in claim 1 wherein said transverse arm is connected to said first signal support through an articulating joint proximal one end of said transverse arm, such that said arm may be pivoted to extend from said first signal support laterally outwardly of said trailer.

3. A traffic control trailer system as in claim 2 wherein said second signal support further comprises a member for releasably holding the end of said transverse arm distal said articulating joint when said signal support and said transverse arm are in said transporting position, whereby the transverse arm is retained against movement when in the transporting position.

4. A traffic control trailer system as in claim 1 further comprising an extendable member interposed between said first signal support and said transverse arm.

5. A traffic control trailer system as in claim 1 wherein said actuating means comprises an extensible piston carried within a cylinder, said piston being actuated by a selectively controllable source of pressurized fluid, such that extension of said piston urges said upper ends of said first and second signal supports away from said base.

6. A traffic control trailer system as in claim 1 wherein said first traffic control signal head is slidably maintained on said transverse arm during transport, erection and operation of the system, whereby said signal head may be positioned at any point along said arm.

7. A traffic control trailer system as in claim 1 further comprising a cross member having opposed ends, one end attached to one of said signal supports and said other end attached to said other signal support.

8. A traffic control trailer system as in claim 1 further comprising at least one support member attached generally perpendicular to said base for supporting said first and second signal supports when signal supports are in said transport position.

9. A traffic control trailer system as in claim 1 wherein said first and second signal supports, each have a pivotal joint interposed intermediate said upper ends of said signal supports and said connections to said base, said pivotal joint dividing said first and second signal supports into respective upper and lower sections thereof, said actuating means connected between said base and said upper sections of at least one of said signal supports for selectively urging said upper ends of said signal supports away from said base, whereby the upper section of the signal support is elevated and lowered between an operating position and a transporting position by selective operation of said actuating means.

10. A traffic control trailer system as in claim 1 further comprising an extendable member having an upper end, said extendable member is interposed between said transverse arm and said upper end of said first signal support, and an actuating means connected to said first signal support and said upper end of said extendable member, such that said actuating means selectively extends and retracts said extendable member.

11. A traffic control trailer system as in claim 1 further comprising a first said trailer and a second said trailer with each said trailer including a tongue connected to said base of each of said trailers and hitch connecting means attached to each said tongue;

hitching means connected to said base of said first trailer intermediate the front and rear portions of said base, whereby said second trailer may be attached to said hitch of said first trailer by said hitch connecting means; and articulation limiting means for limiting pivotal movement of said tongue of said second trailer about a generally vertical axis extending through said hitching means of said first trailer, such that said pivotal movement of said second trailer relative to said first trailer is limited to a predetermined maximum pivot angle.

12. A traffic control trailer system as in claim 11 wherein said articulation limiting means further comprises stops connected to said base of said first trailer for engaging said trailer tongue of said second trailer, limiting said pivotal movement of said second trailer relative to said first trailer to a predetermined maximum pivot angle.

13. A traffic control trailer system as in claim 12 wherein said articulation limiting means further comprises said hitching means being mounted to said first trailer appreciably forward of said rear portion of said trailer such that said first and second trailers are nested, whereby said nesting reduces the overall length of said joined trailers.

* * * * *